United States Patent [19]

Northcote et al.

[11] 4,080,931

[45] Mar. 28, 1978

[54] APPARATUS FOR FEEDING SOLID FUEL TO A FURNACE GRATE

[75] Inventors: Reginald Dennis Northcote, Lower Penn; Frank William Osborne, Coseley, both of England

[73] Assignee: Parkinson Cowan GWB Limited, Dudley, England

[21] Appl. No.: 724,179

[22] Filed: Sep. 17, 1976

[30] Foreign Application Priority Data

Sep. 20, 1975 United Kingdom ..... 38695/75

[51] Int. Cl.[2] ..... F22B 7/12; F23K 3/00; F23J 15/00

[52] U.S. Cl. ..... 122/149; 110/104 R; 110/115; 110/119

[58] Field of Search ..... 122/149; 110/104 R, 110/115, 119

[56] References Cited

FOREIGN PATENT DOCUMENTS

| | | | |
|---|---|---|---|
| 1,110,722 | 10/1955 | France | 110/115 |
| 1,355,054 | 5/1974 | United Kingdom | 122/149 |

*Primary Examiner*—Kenneth W. Sprague
*Attorney, Agent, or Firm*—Arnold, White & Durkee

[57] ABSTRACT

An apparatus for feeding solid fuel to a furnace grate comprising a conduit adapted, in use, to extend downwards through the roof of the furnace, means for feeding solid fuel to the conduit above the lower end thereof said means including at least one fuel propulsion element and drive means to cause the element to move to propel the fuel in a desired direction and means to cause a rapid deceleration in the movement of the element whereby any fuel adhering to the element is flung therefrom.

3 Claims, 3 Drawing Figures

APPARATUS FOR FEEDING SOLID FUEL TO A FURNACE GRATE

BACKGROUND OF THE INVENTION

1. Field of the Invention

This invention relates to apparatus for feeding solid fuel to a furnace grate and also relates to a furnace and to a boiler incorporating such an apparatus.

The invention has been developed particularly for incorporation in a shell boiler of the type, hereinafter referred to as the type described, comprising an outer continuous shell within which is contained the steam and/or water space of the boiler, a furnace grate and a plurality of smoke tubes for passage therethrough of the products of combustion of the furnace and the boiler having apparatus for feeding solid fuel to the furnace grate downwardly through the steam and/or water space of the boiler.

Although an apparatus according to the invention has been particularly designed for incorporation in a shell boiler of the type described, the apparatus may be used to feed any other desired furnace grate.

An object of the present invention is to provide a new and improved apparatus for feeding fuel to a furnace grate.

2. Summary of the Invention

According to a first aspect of the present invention we provide an apparatus for feeding solid fuel to a furnace grate comprising a conduit adapted, in use, to extend downwards through the roof of the furnace, means for feeding solid fuel to the conduit above the lower end thereof said means including at least one fuel propulsion element and drive means to cause the element to move to propel the fuel in a desired direction and means to cause a rapid deceleration in the movement of the element whereby any fuel adhering to the element is flung therefrom.

Preferably the element is mounted on a driven shaft for rotary movement about an axis, at least part of the element being resiliently mounted relative to the shaft and said part of the element being engageable with an abutment whereby on rotation of the shaft said part of the element is prevented, temporarily, from rotation to cause movement of said part relative to the shaft against the resilient bias so that upon release of said part from the abutment said part is rapidly accelerated and then decelerated to return it to its normal orientation relative to the shaft, thus providing a "flick" action whereby any fuel adhering to the element is flung from the element.

Preferably, the element is inherently resiliently deformable whereby said resilient bias is provided.

A plurality of elements may be mounted on such shaft at spaced angular positions.

The shaft may be mounted for rotation about a horizontal axis and the fuel may be fed thereto at an angle inclined to the vertical whereby the element or elements act to propel the fuel in a direction so that it is turned from its direction of feed into the vertically downwardly extending conduit.

Normally the fuel is fed to the element in a horizontal direction.

The apparatus may include a pneumatic fuel feed pipe extending from a source of fuel supply towards the conduit along which fuel is fed by air under pressure and a vent means whereby the pneumatic feed air is vented from the fuel feed pipe at a position adjacent to and upstream of the position of connection between the fuel feed pipe and the conduit.

According to a second aspect of the present invention we provide a boiler of the type described incorporating a fuel feed apparatus according to a first aspect of the invention.

The boiler may be provided with means to extract fuel dust entrapped in the vented air from the vented air and to feed the fuel dust into the furnace of the boiler.

Preferably, when the boiler has a grit arrestor arranged to extract grit entrained in the exhaust gas of the boiler and a means to return the extracted grit to the furnace, the vented air is fed to the grit arrestor whereby the fuel dust is extracted from the air and returned to the furnace.

By venting the pneumatic feed air before entry into the downwardly extending conduit, the speed at which the fuel enters the conduit is reduced thereby reducing breakage of the fuel and so reducing the amount of very fine fuel entering the furnace.

In addition, it may be that the quantity of air introduced into the furnace through the feeding apparatus is too great a quantity for the desired conditions of combustion and hence venting of the pneumatic feed air avoids this problem.

A further problem is that the air in the pneumatic feeding arrangement normally contains a relatively large amount of fine fuel dust, if this fuel dust enters the furnace through the downwardly extending conduit there is a substantial chance that the dust will immediately leave the furnace along with the products of combustion as the dust enters the furnace in relatively close proximity to the outlet thereof.

By venting the pneumatic feed air a large proportion of this dust is also vented and is preferably, as mentioned hereinbefore, reintroduced into the furnace.

The boiler may have, in use, an internal pressure greater than the ambient pressure and there being a conduit extending from the combustion chamber of the furnace whereby the atmosphere in the furnace, and entrained grit, may be vented from the furnace.

The conduit may lead to a grit collection hopper or to a pneumatic grit transport system. In the latter case the pneumatic grit transport system may transport the grit to a conventional grit arrestor and thereafter the grit may be reintroduced into the furnace.

By feeding grit laden air from the furnace, as described hereinbefore, the amount of grit in the flue gases leaving the furnace is considerably reduced or completely eliminated thus avoiding the problems which are conventionally incurred due to grit laden flue gases.

BRIEF DESCRIPTION OF THE DRAWINGS

The invention will now be described in more detail by way of example with reference to the accompanying drawings, wherein.

DESCRIPTION OF THE PREFERRED EMBODIMENT

Figure 1:
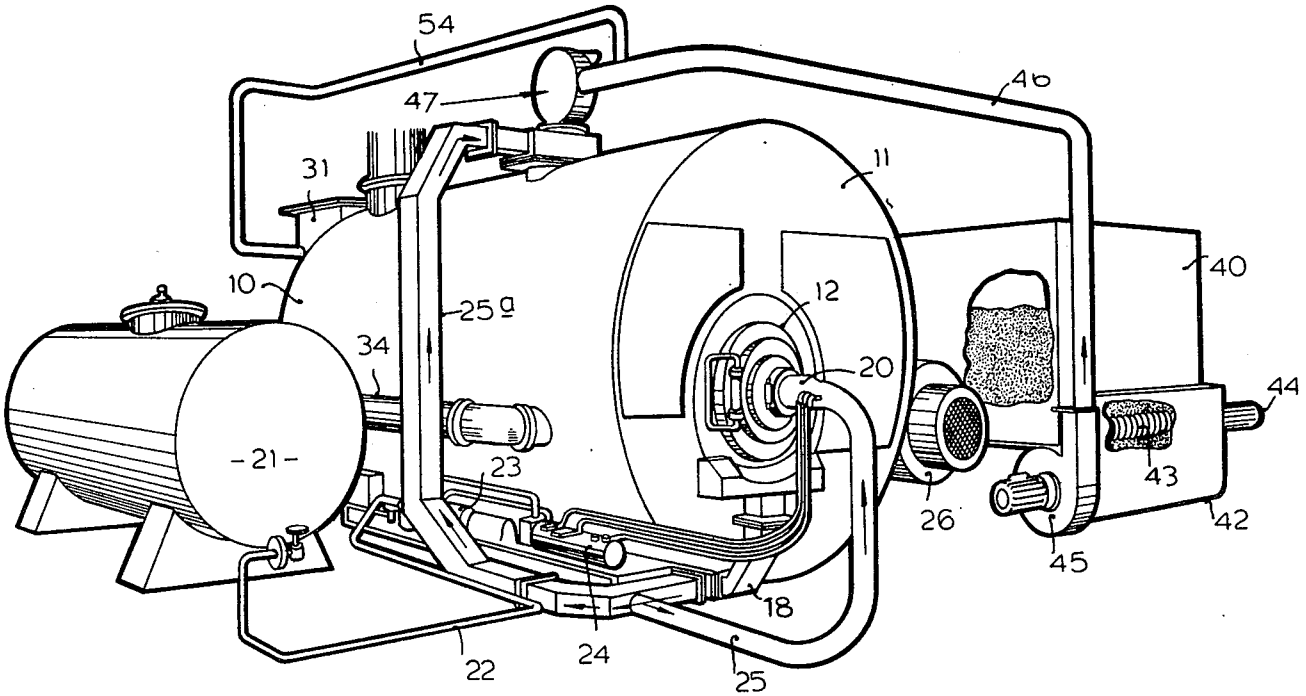
FIG. 1 is a perspective view of a boiler embodying the invention.
Figure 2:
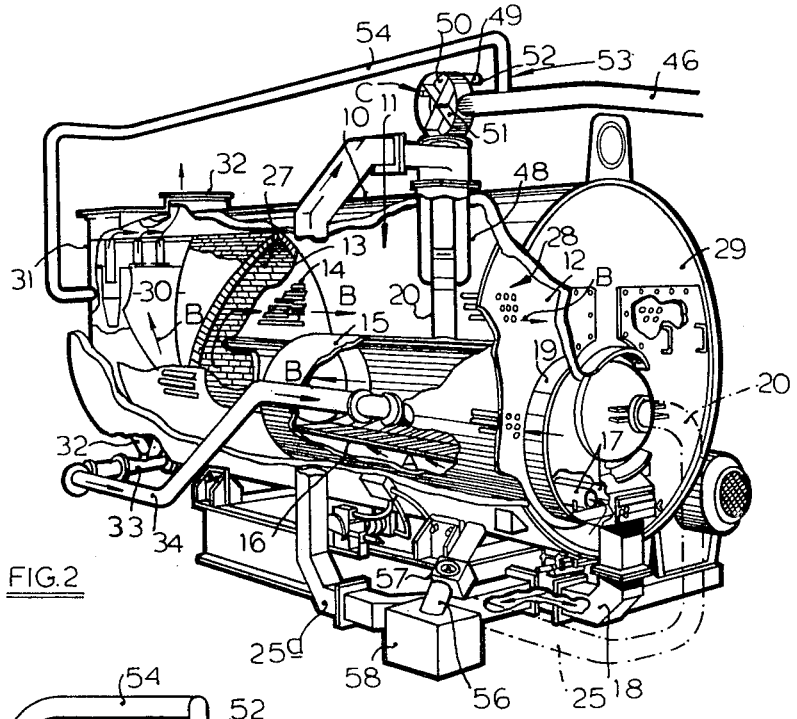
FIG. 2 is a perspective view partly broken away of the boiler of FIG. 1.
Figure 3:
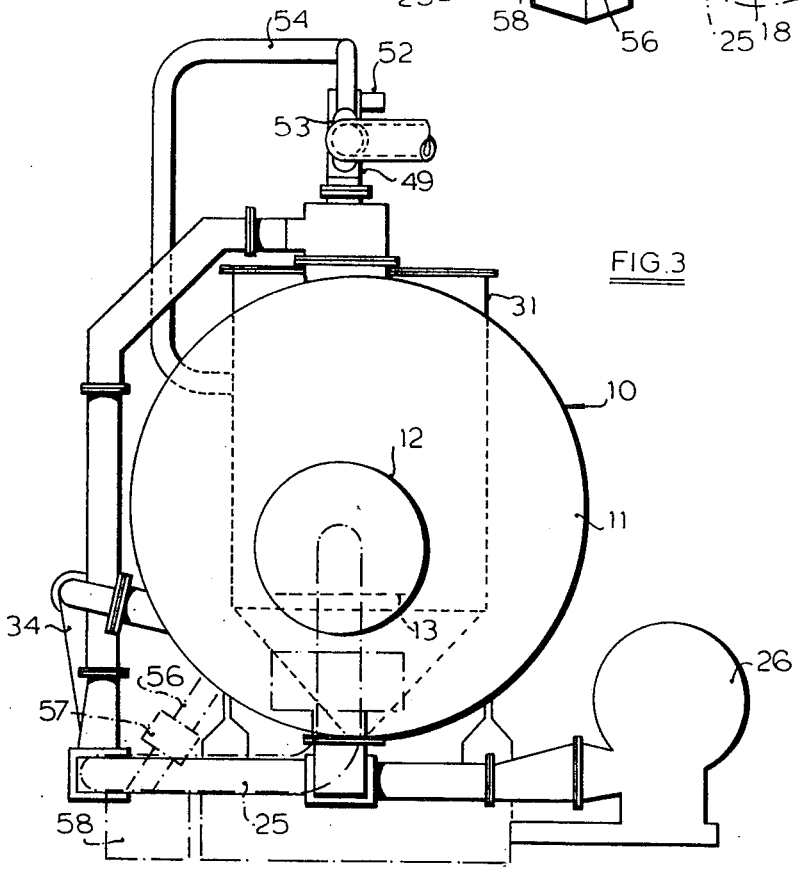
FIG. 3 is a front elevation of the boiler of FIG. 1.

Referring to the drawings, there is shown a shell boiler comprising an enveloping shell 10 the majority of which encloses a steam drum or water space 11. Positioned within the shell 10 are tube plates 12, 13 between which extend a plurality of series of smoke tubes 14 as well as a cylindrical combustion or furnace chamber 15. Positioned within the combustion chamber 15 is a grate 16 to the underside of which is fed primary air through tubes 17 and a duct 18 as shown by the arrows A.

The furnace illustrated in the drawings is a multi-fuel furnace and accordingly the furnace or combustion chamber 15 is provided at its front end 19 with an oil burner 20 to which oil is fed under pressure from an oil tank 21 through a line 22 containing a pump 23 and an electrical pre-heater 24.

A burner air supply duct 25 extends from a blower 26 and is arranged to feed burner air into the combustion chamber 15 along a horizontal axis coincident with the axis of the oil burner 20. The hereinbefore mentioned primary air duct 18 branches from the burner air supply duct 25.

Between the rear end wall of the shell 10 and the tube plate 13 is provided a first smoke box 27 so that the products of combustion from the furnace chamber 15 pass, as shown by the arrows B, into the smoke box 27 and then through a first series of the smoke tubes 14 arranged parallel to the axis of the furnace chamber 15 to a second smoke box 28 provided between the tube plate 12 and the front end wall 29 of the shell. The products of combustion then pass through a further series of the smoke tubes 14 to a chamber 30 at the rear of the boiler and this chamber contains a grit arrestor 31 for separating grit from the combustion products which then pass through a flue 32 and hence into a chimney not shown.

The grit from the grit arrestor 31 passes through a conduit 32 into a venturi neck 33 provided in a conduit 34, which extends from the blower 26 to the furnace chamber 15 at a position adjacent the front end thereof, so that a venturi action provides suction to draw grit from the arrestor 31 into the conduit 34 and so that the grit is introduced into the combustion chamber at a position adjacent the front of the furnace.

Solid fuel, such as coal or wood waste, is contained within a hopper 40. At the base of the hopper is located a screw conveyor 43 driven by a motor 44. The conveyor 43 is arranged to deliver the fuel to a feed pipe 46 leading from a pneumatic blower 45 to a feeding apparatus 47 so that the fuel is fed pneumatically to the feeding apparatus 47.

The apparatus 47 includes a conduit 48 which extends vertically downwardly through the shell 10 and water space 11 of the boiler and passes through the roof of the furnace chamber 15. Suitable means, not shown, are provided to induce the fuel to be distributed evenly over the grate 25. Secondary combustion air, supplied through a branch 25*a* of the duct 25, is fed into the furnace chamber 15 through passageways associated with the conduit 48.

In order to propel the fuel vertically downwardly through the conduit 48 the feeding apparatus includes a generally cylindrical housing 49 within which four spring steel vanes 50 are rotatably mounted. The vanes 50 are fixed to a shaft 51 caused to rotate by an electric motor 52 through a worm and wheel reduction gear. The motor drives the shaft 51 at a speed of approximately 10 to 20 r.p.m.

An abutment is provided in the inner surface of the housing 49 at the position indicated generally at C whereby, as the vanes are rotated a part of the vane which is about to pass the abutment C, engages the abutment and so the part engaged by the abutment is arrested from rotation whilst the shaft 51 continues to rotate. This causes the spring steel vane to bend and hence be resiliently stressed. As the shaft 51 continues to rotate the extent of deflection of the vane in engagement with the abutment is such as to cause the vane to spring past the abutment and thus to be rapidly accelerated and then decelerated in a "flick" type action. This ensures that any particles of fuel which are adhering to the vane are flung therefrom.

The invention has been particularly developed in connection with coal fuel and in such fuel there is a relatively large amount of very fine coal dust which can build up on the vanes and which can lead to clogging of the feed apparatus. The provision of the above described "flick" type action prevents the build up of coal dust on the vanes and thus avoids this problem.

Although the invention has been developed particularly in connection with coal fuel the feed apparatus may be used with other fuel, such as wood waste, for example sawdust.

If desired, either more, or less, than four vanes may be provided, the speed of rotation of the shaft 51 being varied accordingly to maintain 40 to 80 flicks per minute. In addition, instead of the vanes being themselves inherently resilient, as a result of being made of spring steel, the vanes may themselves be rigid but resiliently connected to the shaft 51.

It should also be appreciated that if desired the vanes may be mounted for movement other than by virtue of rotation about the axis of the shaft 51, for example by extending normally and transversely or an endless belt.

A further problem which is encountered, particularly when coal is the fuel, is that the fine coal, as mentioned hereinbefore, when it passes downwardly through the conduit 48 enters the furnace in close proximity to the outlet and hence there is a substantial chance that this coal dust will leave the furnace, before being combusted, along with the products of combustion.

In the hereinbefore mentioned fuel feed arrangement, the air which is used to convey the coal to the apparatus 47 is vented from the delivery pipe 46 at a location 53 a short distance upstream of the fuel feed apparatus 47. The air which is thus vented carries with it a large proportion of the fine coal dust.

It is preferred that the coal dust is introduced into the furnace by being fed along a conduit 54 which extends to the grit arrestor 31 so that it is introduced into the front of the furnace with the grit normally caught by the grit arrestor. Thus the coal dust is introduced into the boiler at the greatest possible distance from the outlet of the furnace and in a relatively unturbulent zone where the dust is more likely to come to rest and to be burnt as compared with introducing it along with the normal coal feed at the centre of the furnace.

It is further preferred to provide a dust extraction arrangement from the furnace chamber 15 by providing a pipe 56 provided with an isolating valve 57 and extending to a grit collecting hopper 58 or, if desired, into a conventional pneumatic de-ashing system, not shown.

Because there is normally a higher pressure in the furnace compared with the pressure in the boiler house, for example approximately 6 inch water gauge, this higher pressure would cause air to leave the furnace chamber through the pipe 56 and to carry with it a substantial proportion of grit present in the atmosphere in the furnace. If desired the grit can be fed to the grit arrestor and hence reintroduced into the furnace.

We claim:

1. A shell boiler comprising an outer continuous shell within which is contained the water space of the boiler, a furnace having a roof, and a plurality of smoke tubes for passage therethrough of the products of combustion of the furnace and the boiler having apparatus for feeding solid fuel to the furnace downwardly through the water space of the boiler, said apparatus comprising a conduit extending downwards through the roof of the furnace, means for feeding solid fuel to the conduit above the lower end thereof, said means including at least one fuel propulsion element and drive means to cause the element to move to propel the fuel in a desired direction, and means to cause a rapid deceleration in the movement of the element whereby any fuel adhering to the element is flung therefrom, and a pneumatic fuel feed pipe extending from a source of fuel supply towards the conduit along which fuel is fed by air under pressure and a vent means whereby the pneumatic feed air is vented from the fuel feed pipe at a position adjacent to and upstream of the position of connection between the fuel feed pipe and the conduit.

2. A shell boiler comprising an outer continuous shell within which is contained the water space of the boiler, a furnace having a roof, and a plurality of smoke tubes for passage therethrough of the products of combustion of the furnace and the boiler having apparatus for feeding solid fuel to the furnace downwardly through the water space of the boiler, said apparatus comprising a conduit extending downwards through the roof of the furnace, means for feeding solid fuel to the conduit above the lower end thereof, said means including at least one fuel propulsion element and drive means to cause the element to move to propel the fuel in a desired direction, and means to cause a rapid deceleration in the movement of the element whereby any fuel adhering to the element is flung therefrom, there being provided means to extract fuel dust, entrapped in the vented air, from the vented air, and means to feed the fuel dust into the furnace of the boiler.

3. A boiler according to claim 2 wherein the boiler has a grit arrestor arranged to extract grit entrained in the exhaust gas of the boiler and a means to return the extracted grit to the furnace, the vented air being fed to the grit arrestor whereby the fuel dust is extracted from the air and returned to the furnace.

* * * * *